US005189248A

United States Patent [19]

Deffayet et al.

[11] Patent Number: 5,189,248

[45] Date of Patent: Feb. 23, 1993

[54] PERFORATING MUNITION FOR TARGETS OF HIGH MECHANICAL STRENGTH

[75] Inventors: Jean Deffayet, Chaville; Alain Lepicard, Orléans; André Winaver, Paris, all of France

[73] Assignee: Thomson-Brandt Armements, Boulogne Billancourt, France

[21] Appl. No.: 761,878

[22] Filed: Sep. 16, 1991

[30] Foreign Application Priority Data

Jan. 16, 1990 [FR] France ..... 90 00430
Jan. 16, 1990 [FR] France ..... 90 00431
Jan. 16, 1990 [FR] France ..... 90 00432

[51] Int. Cl.[5] ..... F42B 10/48; F42B 10/56; F42B 12/24; F42B 15/36

[52] U.S. Cl. ..... 102/386; 102/374; 102/393

[58] Field of Search ..... 102/386, 387, 382, 393, 102/395, 384, 374, 375, 379, 380, 381, 489

[56] References Cited

U.S. PATENT DOCUMENTS

| | | | |
|---|---|---|---|
| 2,356,227 | 8/1944 | Diehl . | |
| 2,539,643 | 1/1951 | Smythe | 114/20.1 |
| 2,693,327 | 11/1954 | Hild | 102/385 |
| 2,968,244 | 1/1961 | Maas et al. . | |
| 3,081,704 | 3/1963 | Boswell . | |
| 3,157,123 | 11/1964 | Matheson | 102/381 |
| 4,568,040 | 2/1986 | Metz | 102/384 |
| 4,573,412 | 3/1986 | Lovelace | 102/374 |
| 4,876,963 | 10/1989 | Deffayet | 102/374 |
| 5,080,305 | 1/1992 | Stencel et al. | 102/384 |

FOREIGN PATENT DOCUMENTS

| | | |
|---|---|---|
| 1578089 | 7/1975 | Fed. Rep. of Germany . |
| 1549618 | 12/1968 | France . |
| 2376300 | 7/1978 | France . |
| 2479972 | 10/1981 | France . |
| 113975 | 3/1918 | United Kingdom . |
| 329967 | 5/1930 | United Kingdom . |
| 551515 | 2/1942 | United Kingdom . |
| 543950 | 3/1942 | United Kingdom . |
| 1217465 | 12/1970 | United Kingdom . |

OTHER PUBLICATIONS

Revue Intn. de Defense, vol. 12, No. 4/1979, pp. 603–608 "La Bombe de Pénétration Durandal" p. 605.

*Primary Examiner*—David H. Brown
*Attorney, Agent, or Firm*—Oblon, Spivak, McClelland, Maier & Neustadt

[57] ABSTRACT

The invention concerns a perforating munition for targets possessing high mechanical strength. A perforating munition, released at very low altitude to prevent destruction by ground-air defense systems, possesses a braking system constituted by a parachute (24) to give the velocity vector of the munition a position that is as close as possible to the vertical, thus enabling an improvement in the effectiveness of the munition on impact. To improve the positioning of the velocity vector with respect to the vertical, the munition has a curvature correction device comprising a back projector (13) that is fixedly joined to the rear part (2) of the munition and is positioned in a ring-like way around a front part (1) of the munition, so as to reduce the curvature of the munition in order to increase the effectiveness of the munition.

8 Claims, 9 Drawing Sheets

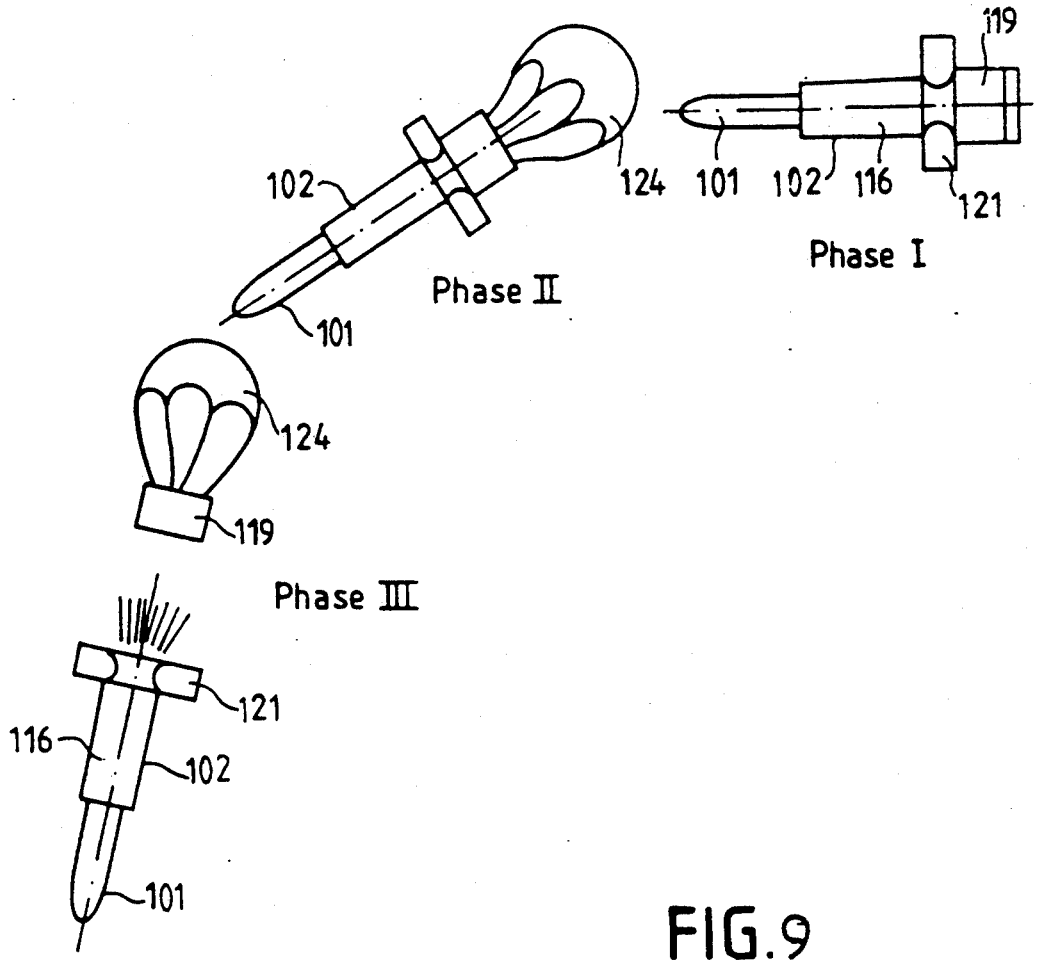
FIG.9
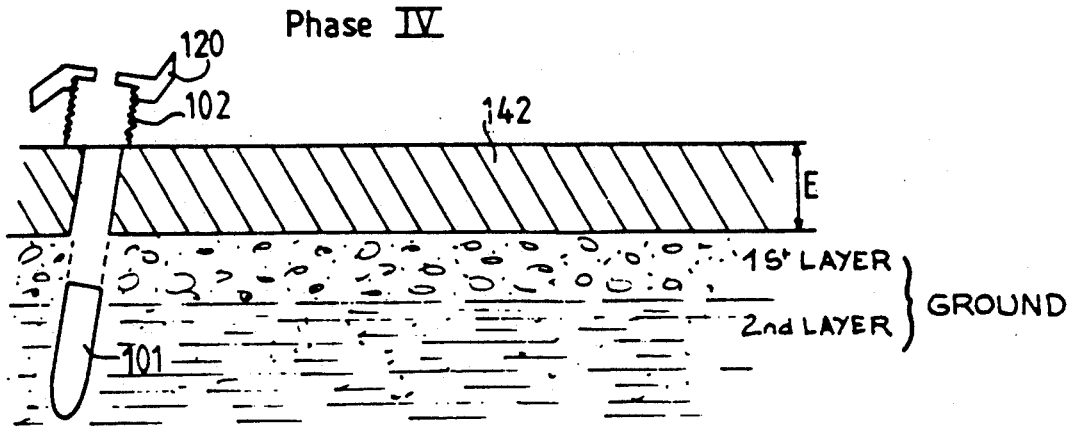

PERFORATING MUNITION FOR TARGETS OF HIGH MECHANICAL STRENGTH

BACKGROUND OF THE INVENTION

The invention relates to a perforating munition for targets possessing high mechanical strength.

Perforating munitions used, for example, against concrete runways are generally placed in an air vehicle, called a carrier, that has to fly over the target at very low altitude and very high speed. To avert the risk of the destruction of the air vehicle by enemy ground-air defenses, this vehicle has an altitude of the order of 75 m and a speed of the order of 300 m/s. At an instant determined so that the desired objective is reached, the air vehicle ejects the different munitions with high horizontal velocity and in a horizontal attitude parallel to the plane containing the target as shown in FIG. 1. Each munition M, at the end of its trajectory, at impact I, should have a velocity vector that is as close as possible to the vertical in order to facilitate the complete penetration of the munition into the target before the final explosion. The munition therefore has an incidence defined as the angle between the vector of velocity with respect to the target and the vertical to the target placed horizontally. To this end, each munition has a braking phase F and an acceleration phase A by which the munition is respectively given an orientation and a velocity necessary for a perforating munition to function in order to damage a concrete runway. The phase of acceleration of the munition should be triggered at an altitude Z sufficient for the end of the propulsion to take place before impact. It being known that this altitude is determined as a function of a length 1 of the propelled-mode trajectory defined by:

$$1 = \frac{V + 0}{2} \cdot T \cdot \cos i$$

- $V_o$: velocity of the munition at the end of bracking;
- V : velocity of the munition at the end of propulsion;
- T : combustion time of the propellant;
- i : angle of incidence which is the angle between the velocity vector with respect to the target and the vertical of the target placed horizontally;

and that these parameters are determined so as to have, for example, an impact velocity V=350 m/s and a combustion time which, in the present state of the art and in view of the geometrical constraints, cannot be reduced to less than 0.2 s, the length of the propelled-mode trajectory will be about 35 m, i.e. the propulsion has to be ignited at an altitude of at least Z=40 m. Furthermore, at the end of the braking phase F, the munition should have an attitude close to the vertical, for example an incidence i=15°, after a ballistic drop equal to the difference between the altitude of release and that of the ignition of the propulsion, i.e. under the conditions chosen here above, the altitude of release being 75 m, there are only 35 m available to obtain the desired attitude. To obtain this result, it is necessary to use a braking system, for example a parachute positioned in the rear of the munition, the dimensions and sturdiness of which would be incompatible with the space available.

There are numerous munitions designed to perforate and damage surfaces possessing high mechanical strength. These munitions, the effectiveness of which depends on a large number of parameters (such as the penetration depth, the quantity of explosive charge etc.) are generally released at very low altitude from an air vehicle possessing dictated dimensions that determine a volume in which the munition has to be housed. Since this air vehicle has a determined size, it limits the number and size of the modules contained inside the perforating module. To provide for the performance characteristics of a munition such as this, it is necessary to position the largest number of modules possible within the munition. To this end, it is therefore necessary to find an architecture of the munition in order to exploit the available space as efficiently as possible.

SUMMARY OF THE INVENTION

The aim of the invention is to overcome the abovementioned drawbacks by proposing an approach that makes it possible to use a braking system with acceptable dimensions.

An object of the invention is a perforating munition comprising a device to correct the curvature of a trajectory, said munition being launched from an air vehicle with a horizontal velocity and attitude and being designed to attack a target with horizontal layout, and comprising a braking system positioned in the rear of the munition, said braking system being fitted out with a parachute which, when it is unfolded, gives the munition a first incidence that is as close as possible to the vertical, a munition characterized in that it comprises a back propulsion means positioned on the munition so as to reduce the first incidence of the munition obtained through the parachute to increase the efficiency of said munition.

Another object of the invention is a perforating munition comprising a front part formed by a casing containing an explosive charge and a rear part, fixed to the front part by a fastening means and comprising a set of modules providing for the working of the munition, characterized in that at least one of the modules is placed in an annular way around a part of the front part of the munition to limit the space occupied by the munition in ensuring its effectiveness.

Another object of the present invention is a munition of the anti-runway bomb type, for a target of high mechanical strength, capable of penetrating sufficiently even into very thick slabs.

To this effect, it comprises at least one front part, containing an explosive charge, designed to penetrate the runway; according to the invention, the external surface of the front part has longitudinal grooves which have the function, firstly, of reducing the frictional forces that counter penetration into the runway and, secondly, of increasing the transversal rigidity of the munition so as to reduce the risk, during an oblique impact, of the bending of the munition and its ricocheting.

In a particular embodiment, the casing of the front body is furthermore made so that the grooves form longitudinal hollow charges which, during the explosion, pre-facture the concrete surrounding the front body.

BRIEF DESCRIPTION OF THE DRAWINGS

The invention will be understood more clearly from other explanations resulting from the following description, given by way of a non-restrictive example and illustrated by the appended drawings, of which:

FIG. 9 represents a drawing of the operation of an embodiment of a munition against a concrete runway;

DESCRIPTION OF THE PREFERRED EMBODIMENTS

In these different FIGS., the same references relate to the same elements.

Figure 2:
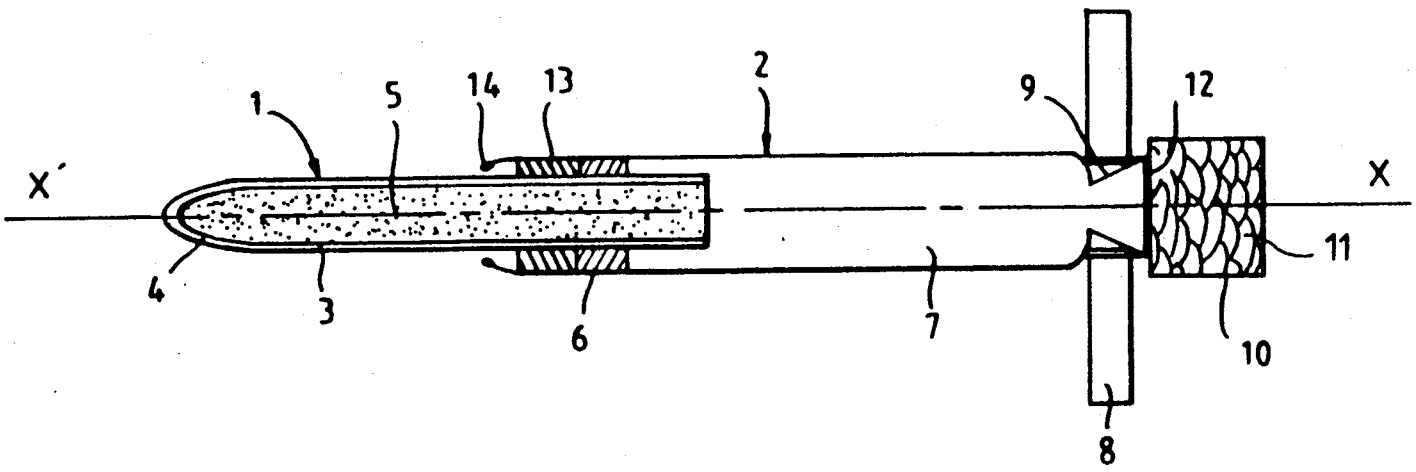
FIG. 2 represents a drawing of an embodiment of a perforating munition fitted out with a device for correcting the curvature of a trajectory according to the invention.

FIG. 2 shows a first embodiment of the munition fitted out with the device according to the invention.

This munition has two parts: a front part 1, designed to damage a surface of high mechanical strength, for example a concrete runway, either by penetrating it preferably throughout its length or by going through it and exploding beneath it, and a rear part 2 which may or may not have a diameter greater than that of the front part 1 and is designed to fulfill a set of ballistic functions of the munition.

The front part 1 is, for example, cylindrical. It is constituted by a casing 3, made of steel for example, which ends in the front with a nose 4, for example a conical nose, and contains an explosive charge 5. Other elements may constitute the front part 1, for example a ballast making it possible, respectively, to improve the penetrating capacity of the munition and to shift the center of gravity of the munition, or a priming fuse that can be used to trigger the explosion of the charge and can be extended by a priming channel. These elements are not shown in FIG. 1 and do not prevent the working of the device according to the invention. The front part 1 of the munition is extended, in the exemplary embodiment, within the interior of the rear part 2 which thus covers it in a ring-like way.

A fastening system 6 keeps the rear part 2 on the front part 1 so that the rear part 2 does not counter the penetration of the front part 1 into the concrete runway. The rear part 2 comprises, among other elements, a propulsion means 7, one part of which can fit into the annular space between the front part 1 and the rear part 2, a tail unit system constituted by fins 8 fastened, for example, to the rim of a nozzle 9 positioned in the rear of the propulsion means 7 and a braking system comprising, for example, a box 10 within which there is placed a parachute 11 and which is fixed to the nozzle 9 of the propulsion means 7, for example by a mechanical fastening system 12 that can be unlocked.

Figure 1:
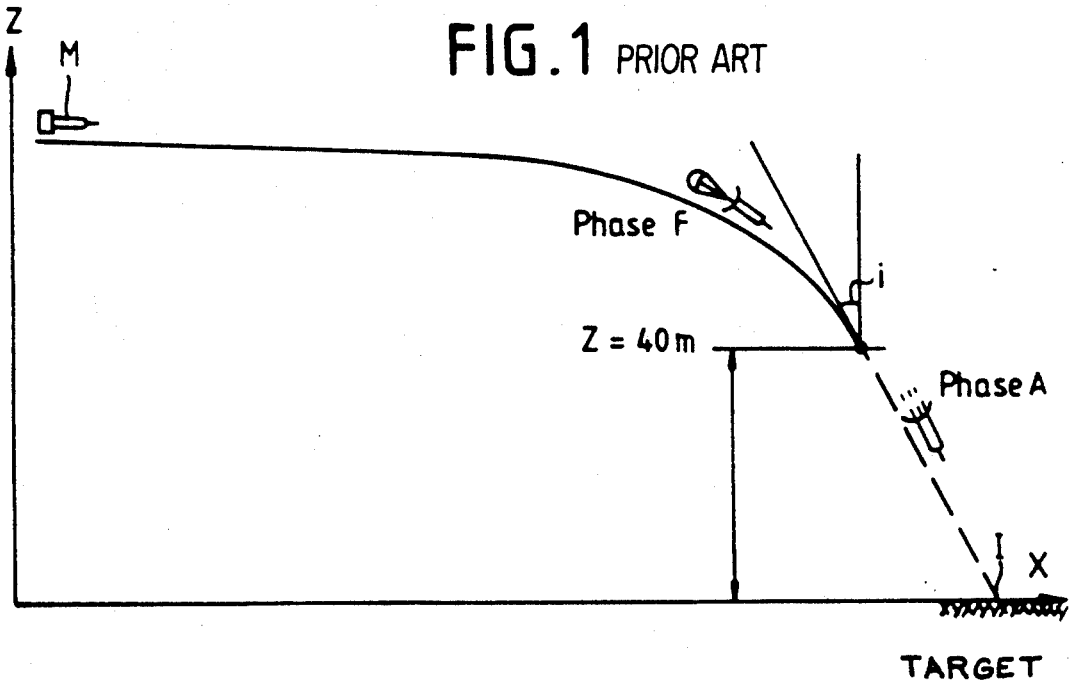
FIG. 1 PRIOR ART
FIG. 1 represents a curvature of the trajectory according to the prior art.

After the munition has been dropped from an air vehicle containing several of these munitions, the munition follows a trajectory similar to the trajectory shown in FIG. 1. However, in view of the size of the air vehicle containing the munitions, the box 10 of the braking system has, for example, a square section to facilitate the stowage of the munitions in the air vehicle. In this way, the box 10, which has dimensions greater than those of a circular section box generally used, enables the parachute 11 contained inside the box 10 to have greater dimensions. This parachute 11 makes it possible to obtain an incidence of the order of 30° for example. Since this incidence is too high, it is enough, during the trajectory of the munition, to bring into operation a device to correct the curvature of a trajectory according to the invention, comprising a back propulsion means, for example a back propulsion unit 13 fixedly joined to the rear part 2 of the munition. The back propulsion unit 13 is positioned, for example, in the front of the rear part 2 of the munition covering the front part 1 of said munition, in the annular space that is included between the two parts, the front part 1 and the rear part 2, and contains other elements contained in the rear part 2. The back propulsion unit 13 is provided, for example, with nozzles 14 by which the gases coming from the combustion inside the propulsion means 7 are expelled. These nozzles 14 are positioned, for example, symmetrically with respect to a longitudinal axis XX' of the munition to provide a thrust parallel to the axis XX' of the munition. This back propulsion unit 13 has characteristics which it i indispensable to define for this application. For, certain features of the propulsion means, for example an excessively great thrust, an excessively lengthy combustion time and an ill-defined instant of ignition may disturb the trajectory and/or reduce or even cancel out the effect of correction of the curvature of the munition and may hence, in this way, diminish the performance characteristics of the munition. To determine these elements, it is enough to have knowledge of the following principle: from the known relationships:

$$\frac{V}{R} = g \cos p$$

$$R = \frac{ds}{dp}$$

$$dz = ds \sin p$$

where:

V : velocity of the munition
R : radius of curvature of the trajectory
g : acceleration due to gravity
p : slope of the velocity
s : curvilinear abscissa
z : altitude A function F is deduced giving the relationship between the slope variation related to the altitude variation and the velocity which is:

$$F = \frac{dp}{dz} = \frac{g}{V^2 tg\, p}$$

This relationship allows us to state that a reduction imposed on the modulus of the velocity of the munition results in an increase in the inclination of the velocity vector of the munition, i.e. a diminishing of the incidence at impact Simulations show that, for a given reduction of V, the minimum incidence is obtained when the back propulsion is ignited at a time, hence at an abscissa point, that is precise. This reduction in the velocity should not be too great, so as not to damage the effectiveness of the parachute.

Furthermore, to prevent a pitching oscillation with an excessive amplitude, caused by an excessively fast rotation of the munition and causing the target to be reached with an excessively oblique incidence corresponding to the angle between a longitudinal axis of the munition XX' and the velocity vector of the munition, the thrust given by the back propulsion unit can be spread out over a relatively long period of time with an earlier ignition time.

Figure 3:
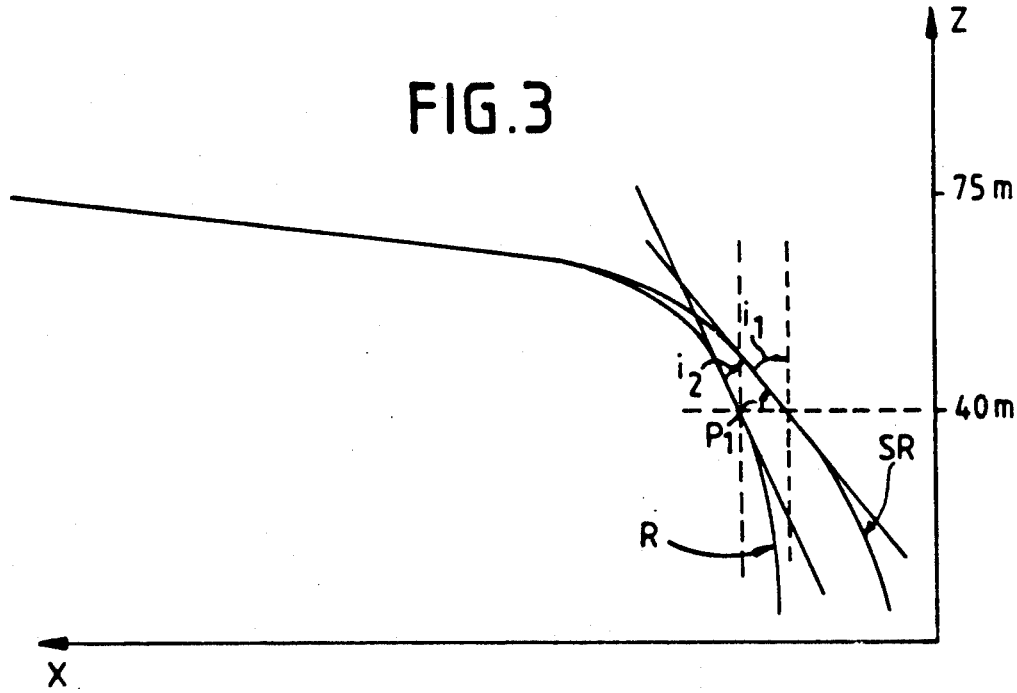
FIG. 3 represents a comparison of the curvature of a trajectory for a perforating munition that is fitted out with the device according to the invention and a device that is not fitted out with the device according to the invention.

FIG. 3 represents the comparison between the trajectory of a munition without back propulsion SR and the trajectory of a munition with back propulsion R. The slope $p_1$ of the trajectory at an altitude z=40 m is, for example, of the order of 60° ($i_1$=30°) when there is no back propulsion, and may go down to below 30° ($i_2$=15°) when there is back propulsion.

The device according to the invention can be applied to perforating munitions for targets of high mechanical strength, but it can be applied also to all munitions that have an almost vertical impact and for which it is difficult to obtain a minimal incidence solely through the use of a parachute.

Figure 4:
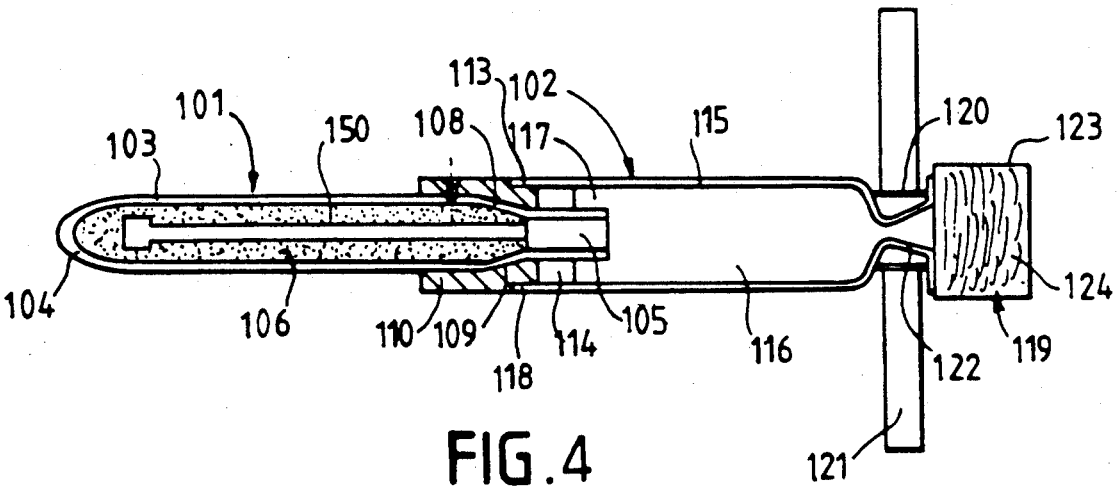
FIG. 4 represents a drawing of an embodiment of a perforating munition according to the invention.

FIG. 4 shows a drawing of a first embodiment of the munition according to the invention. The munition has two parts: a front part 101 designed to damage a surface of high mechanical strength, for example a concrete runway, either preferably by penetrating it throughout its length or by going through it and exploding beneath it, and a rear part 102 designed to fulfill a set of ballistic functions of the munition. This rear part 102, which is fixedly joined to the front part 101 before the impact of the munition on the target, is separated at the instant of the impact so as not to slow down the penetration of the target by the front part 101.

The front part 101 is, for example, cylindrical. It is formed by a casing 103, made of steel for example, that ends in the front in a nose 104, for example conical, and in the rear, for example, in a priming fuse 105 placed behind an explosive charge 106 contained inside the casing 103 and enabling the explosion of the charge to be triggered when the perforation is done, the priming of the explosive charge being transmitted, for example to the front of the munition, by a priming channel 150 to increase the destructive power of the munition. The external surface of the casing is, for example, smooth but it may also have any other shape, for example formed by grooves, firstly in order to decrease the frictional forces during penetration and, secondly, to increase the transversal rigidity of the munition in order to restrict the bending of the munition when it hits the target.

Figure 5:
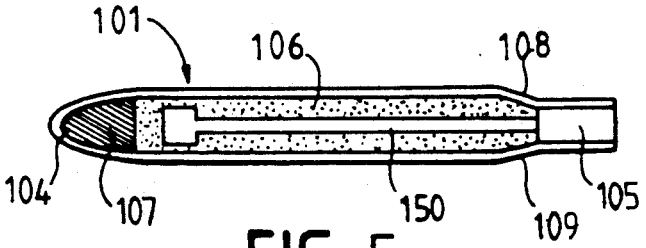
FIG. 5 represents an alternative embodiment of the front part of the perforating munition according to the invention.

The front part 101 of the munition, as shown in the drawing of FIG. 5, may include other elements. This FIG. 5 shows all the elements described in FIG. 4, constituting the munition. However, an additional element has been added to the front of the front part 101. This element constituting a ballast 107 is placed, for example, in the nose 104 and on a part of the front part 101. This ballast 107, which is constituted by a dense material, for example tungsten makes it possible, firstly, to improve the penetration capacity of the front part 101 by increasing its mass and, secondly, to reposition the center of gravity of the munition by shifting it frontwards so as to reduce the risks of rotation and bending of the munition at the instant of impact on the target.

Figure 6:
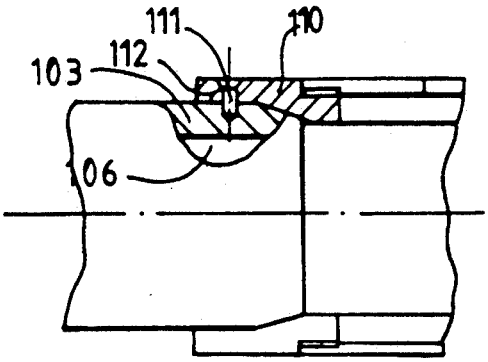
FIG. 6 represents a means for fastening the front part of the munition to the rear part of the munition according to the invention.

The maximum diameter of the front part 101 has a value smaller than that of the rear part 102, so that the front part 101 is extended into the rear part 102. In this way, the rear part 102 covers a part of the front part 101 in an ring-like way. Furthermore, since the effect of penetration of the munition, notably of the front part 101, is due essentially to the kinetic energy, it is indispensable to transmit the thrust force of the rear part 102 to the front part 101 during the first penetration part. To this end, the rear structure of the casing 103 of the front part 101 has, for example, a conical type of contraction 108 on its periphery so that a fastening means supports an oblique element 109 of the contraction 108. This fastening means is, for example, an asymmetrical fastening piece, for example a fastening ring 110 fixed to the rear part 102, for example by laser soldering after the positioning of the propulsive charge at a stop 113 of the fastening ring or by threading at this same stop. This asymmetrical fastening is used, firstly, to transmit the thrust from the rear part 102 of the munition to the front part 101 of the munition before the impact of the munition on the target and secondly to achieve the release, upon the impact of the munition on the target, of the front part 101 from the rear part 102 to facilitate the penetration of the front part 101 of the munition into the target. This fastening ring 110, one embodiment of which is shown in detail in FIG. 6, enables the front part 101 to be fixedly joined the rear part 102 by means of screws 111 positioned, for example, in holes 112, six in number for example, made in the ring 110. During the screwing in, the screws 111 penetrate the interior of the casing 103 on a thickness E that is far smaller than the thickness of the casing 103 to prevent any disturbance leading to a deterioration of the front part 101. These screws are, for example, shear screws which, during the penetration of the munition into the target, are sheared, thus allowing the front part 101 to slide freely.

In view of the dimensions imposed on the munition, the dimensions of a front part 101 containing a quantity of explosive charge needed for maximum damage to the target and a rear part 102 containing numerous modules enabling the different operating phases (propulsion, guidance, steering, braking, inclination etc.) to be carried out, the space occupied by the munition needs to be limited by a special arrangement of all the modules contained in the rear part 102 of the munition, each of the modules fulfilling a function indispensable to the desired effectiveness of the munition.

Figure 7:
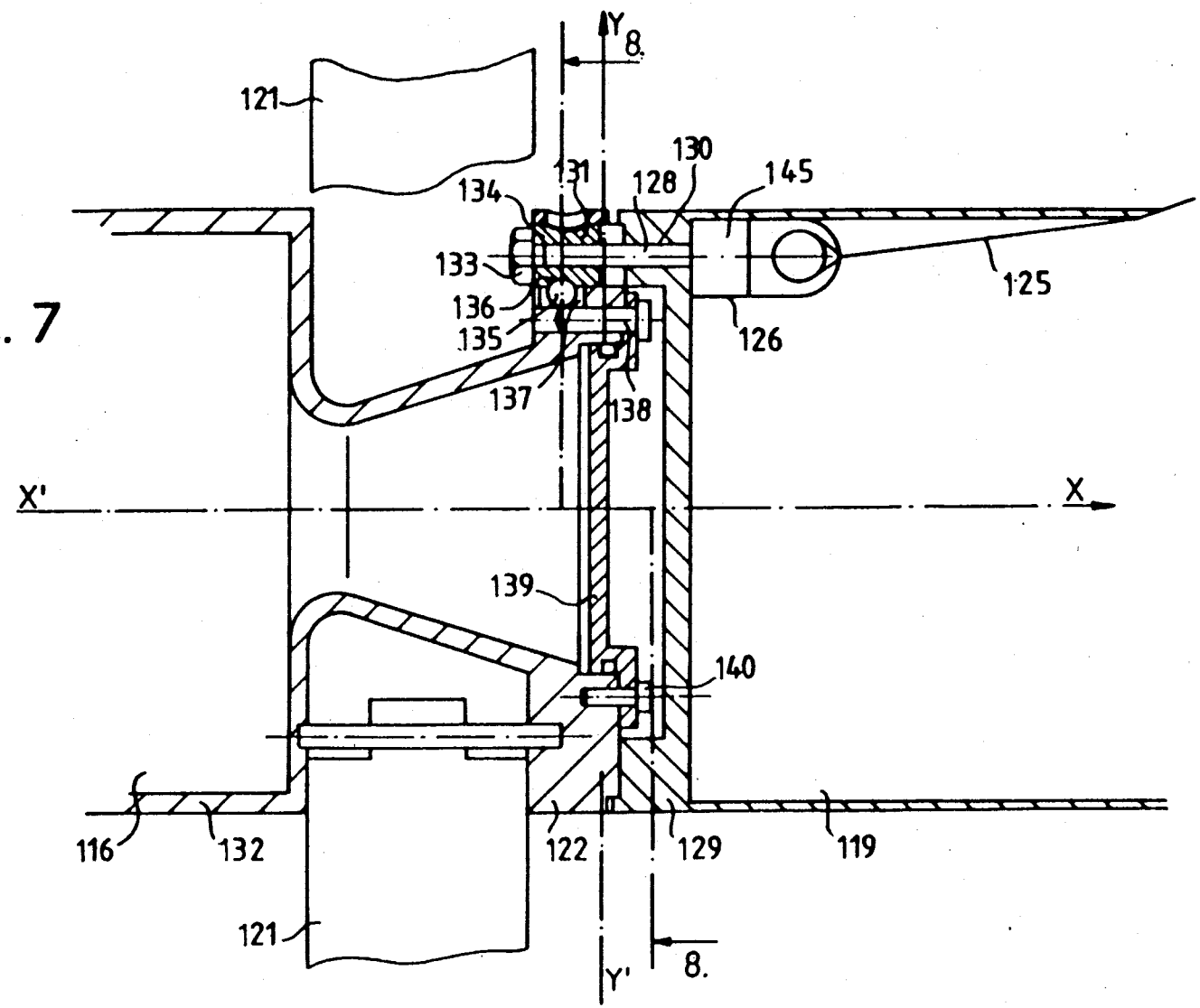
FIG. 7 represents a drawing of an embodiment of a fastening system that can be unlocked, fitted into the munition according to the invention.

The rear part 102 comprises, for example, a braking system 119, within which there is placed a parachute 124, a tail unit 120 to provide for the balance of the munition, a propulsion means 116 to increase the velocity of the munition, the triggering of which causes the release of the braking system 119 and a sequencer 114 to provide for the working of the different phases The modules of the rear part 102 are arranged as follows:

the sequencer 114 is positioned in a ring-like way on the rear of the front part 101; this sequencer 114 has, for example, a diameter smaller than the diameter of a casing 115 of the propulsion means 116 so that the casing 115 covers the sequencer 114 during the making of the munition. To prevent any misalignment of the different modules, which would make it difficult to manufacture the munitions and to resolve any problems of tight sealing and aerodynamic characteristics, the modules of the rear part 102, capable of being positioned around the rear of the front part 101, will have a diameter smaller than the diameter of the casing 115 in order to be covered;

the propulsion means 116 comprising, for example, an annular additional part 117 is placed behind the sequencer 114. A front end 118 of the casing 115 of the propulsion means 116 is fixed to the stop 113 of the fastening ring 110 holding the assembly to the front part. The rear of the propulsion means 116 has a nozzle 122 by which gases resulting from the combustion, for example of a solid propellant, are expelled;

the tail unit 120 constituted, for example, by fins 121 is fixed, for example to the rim of the nozzle 122 of the propulsion means 116. The two fins shown in FIG. 4 are unfolded and locked, but this number of fins is in no way restrictive. In the initial position, these fins 121 are folded along the structure of the casing 115;

the braking system 119 comprising, for example, a box 123 within which there is placed a parachute 124, is placed facing the nozzle 122; it is fixed to the nozzle 122, for example by a fastening system that can be unlocked, an embodiment of which is shown in FIG. 7.

This system has different mechanical means:

first mechanical means formed by an inner cap 139 to which there is fixed at least one finger 138;

second mechanical means consisting of a small ball 135 and an element 134;

third mechanical means consisting of at least one tie-rod 126 formed by a base 145 and a rod 128;

the position of which shall be described here below. The braking system 119 contains the parachute 124 (not shown), the shround lines 125 of which are connected to one or more tie-rods 126, for example, positioned on the internal periphery of the braking system 119; The tie-rod or tie-rods 126 are formed, for example, by a base 145 and a rod 128 so that, firstly, the rod 128 goes through the front 129 of the braking system 119 by means, for example, of a first cylindrical hole 130 positioned on the internal periphery of the braking system 119 and, secondly, the base 145 lies on the front 129 of the braking system 119. Facing this cylindrical hole 130, a second cylindrical hole 131 has, for example, been machined on the rear 132 of the propulsion means 116 so that the tie-rod 126 provides for the fastening of the braking system 119 to the injector tube 122 of the propulsion means 116 by a nut 133 positioned on the threaded end of the rod 128; this nut 133 is supported, for example, on an element 134 which is, for example, solid and is placed within the second hole 131, the diameter of which is different from the diameter of the first hole 130. According to one variant, the assembly 131, 133 and 134 is cast in one piece and is screwed into the base 145 by means of the threaded rod 128. The element 134 is held fixedly in the rear 132 of the propulsion means 116, for example by a small ball 135 lying, for example, within a groove 136 made on the periphery of the element 134. This small ball 135, which is placed, for example, in a third cylindrical hole 137, perpendicular to a longitudinal axis X'X of the munition, is held against the element 134, for example by means of a finger 138, placed in a fourth cylindrical hole parallel to the longitudinal axis XX' of the munition. This finger 138 is an element of an inner cap 139, circular for example, which provides for the closing of the injector tube 122 from the rear 132 of the propulsion means 116. This inner cap 139 is held on the rear 132 of the propulsion means 116, for example by four pins 138 and also by shear screws 140, for example two in number, only one of which is shown in this FIG. It is possible to use fastening systems other than the shearing screws 140, for example clips or any other means. This inner cap 139, which is thus fixed to the rear 132 of the propulsion means 116 and is fixedly joined to the pins 138 preventing the escape of the small balls 135 holding the tie-rods 126 to which the shroud lines 125 of the parachute 124 are fixed, gets separated, at a determined instant, under the effect of a thrust force. This thrust force enables it to carry out a translational motion, firstly shearing the screws 140 and secondly drawing along the pins 138, fixed to the inner cap, which release the small balls 135 unfastening the solid elements 134 and thus providing for a translational motion along the axis X'X of the tie-rods 126. These tie-rods 126, once released, enable the separation or separation of the two modules constituted by a propulsion means 116 and a braking system.

The translational motion of the inner cap 139 is done, for example along an axis substantially parallel to X'X.

The thrust force separating the inner cap 139 is generated, for example, by the gases coming, for example, from the propulsion means 116 when it is ignited. The use of this propulsion means 116 to give the necessary thrust force makes it possible to simplify the fastening system that can be unlocked through the use of the elements proper to the munition, in this case the gases of the propulsion means 116 which have the initial function of giving the munition a determined velocity in order to increase its effectiveness, to trigger the separation of the elements.

Figure 8:
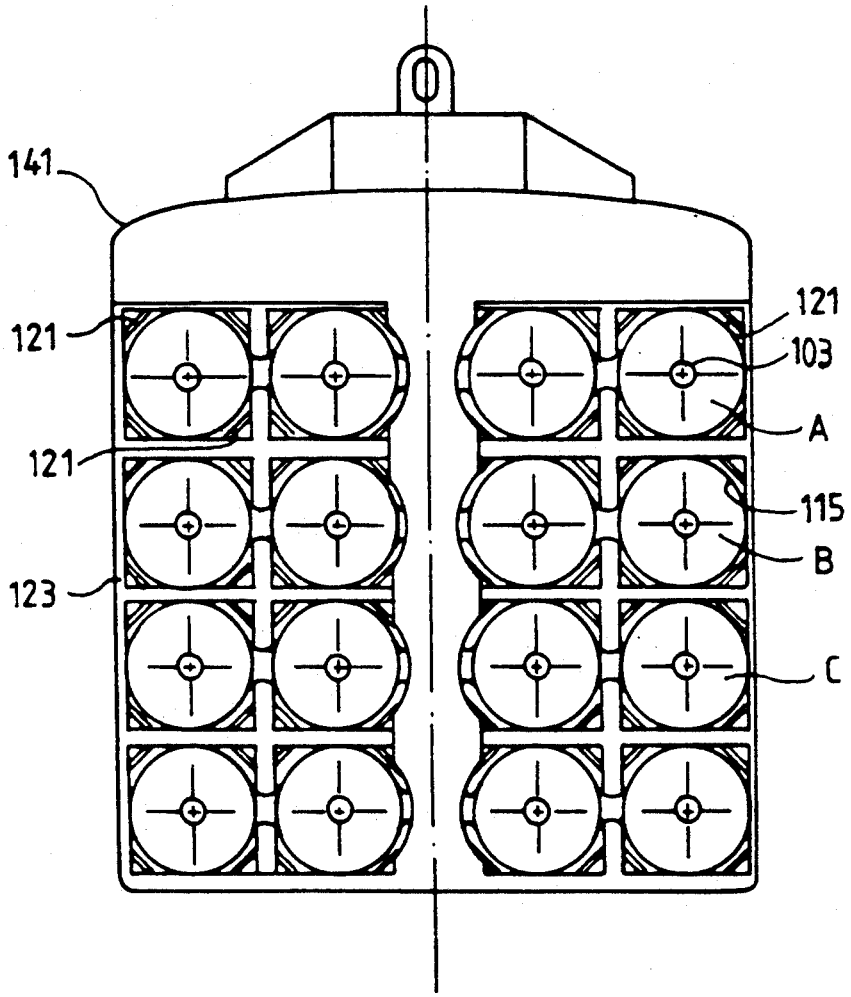
FIG. 8 represents a drawing of a mode of integration of the munitions into a carrier.

The box 123 of the braking system 119 has, for example, a square section to increase the available volume of the parachute necessary to obtain a sufficiently low incidence for the munition. In the exemplary embodiment, the incidence is of the order of 30°. To reduce this incidence, it would be necessary to increase the dimensions of the volume of the parachute. This appears to be difficult in view of the dimensions dictated for the munition. The square section of the box 123 further facilitates the stowage of the munitions within the bays of the air vehicle which may be, for example, a stand-off transport plane carrying munitions as shown in FIG. 8.

This air vehicle 141 carries numerous munitions A, B, C comprising the different modules described here above. The munition A comprises, in its rear part, the square-sectioned box 123 containing the braking parachute (not shown), the propulsion means, the casing 115 of which has, for example, a circular section and the tail unit 115 comprising, for example, four fins which, in the folded position, are housed in the space located between the casing 115 and the square-sectioned prism of the box 123. In its front part, the munition A comprises the front part, the casing 103 of which is cylindrical.

The following is working of the munition according to the invention, illustrated in FIG. 9, in an application designed to damage a horizontal target: the munition is dropped, for example from an air vehicle, on a concrete runway 142, on the ground. The concrete runway 142 has a thickness E and has to be damaged. This munition comprises the braking system 119, within which there is placed the parachute (not shown), the tail unit 120 to provide for the balance of the munition. The triggering of the propulsion means 116 provides for the release of the braking system 119 and the front part 101 extending in the propulsion means 116 and containing the explosive charge that is needed to damage the target and is not shown in this FIG. 9. After a period of flight in free fall, represented by the phase I, when the munition is subjected to the earth's gravity, resistance from the air and the velocity acquired when it was released, the munition braking parachute is unfolded, in the phase II, to deflect the trajectory of the munition towards the target, in this case the concrete runway 142. At the end of the braking phase, the braking system gets separated from the munition in the phase III by means of the fastening device that can be unlocked, under the effect of the gases coming from the propulsion means 116 which, furthermore, makes it possible to give the munition a velocity needed for the penetration, by the front part 101, of the concrete runway 142. In the phase IV, during the impact of the front part 101 on the concrete runway, the fastening ring (not shown) holding the front part 101 to the rest of the munition is separated, allowing only the front part 101 of the munition to penetrate the concrete runway, in benefiting from all the kinetic energy of the munition.

The destructive capacity of the munition depends, in particular, on:

- the strength of the target penetrated;
- the strength of the body of the front part 101 containing the explosive charge;
- and
- quantity and specific energy of the explosive charge contained in the front part;
- the position of the "center" of development of the explosion; an optimum depth "h", depending on all the above-mentioned characteristics, is defined.

The perforating capacity should be defined so that the depth of penetration of the center of the explosion (generally the point of the priming of the explosive charge) is effectively at the position "h". To this effect, it may be useful to extend the priming channel, if necessary upto the vicinity of the nose, i.e. immediately behind the ballast.

In the exemplary embodiment described, only the sequencer and a part of the propulsion means are positioned in a ring-like way around the front part 101. This embodiment is a particular one and it is possible to consider placing other modules needed for the working of the munition around the front part 101 of the munition to meet the dimensions required for the munition.

The arrangement of the modules in the munition according to the invention can be applied particularly to anti-runway munitions, but it can be used in any munition that has to meet constraints of cost, carriage and use and is designed to perforate a target having a surface of high mechanical strength, before damaging this target by explosion.

Figure 10:
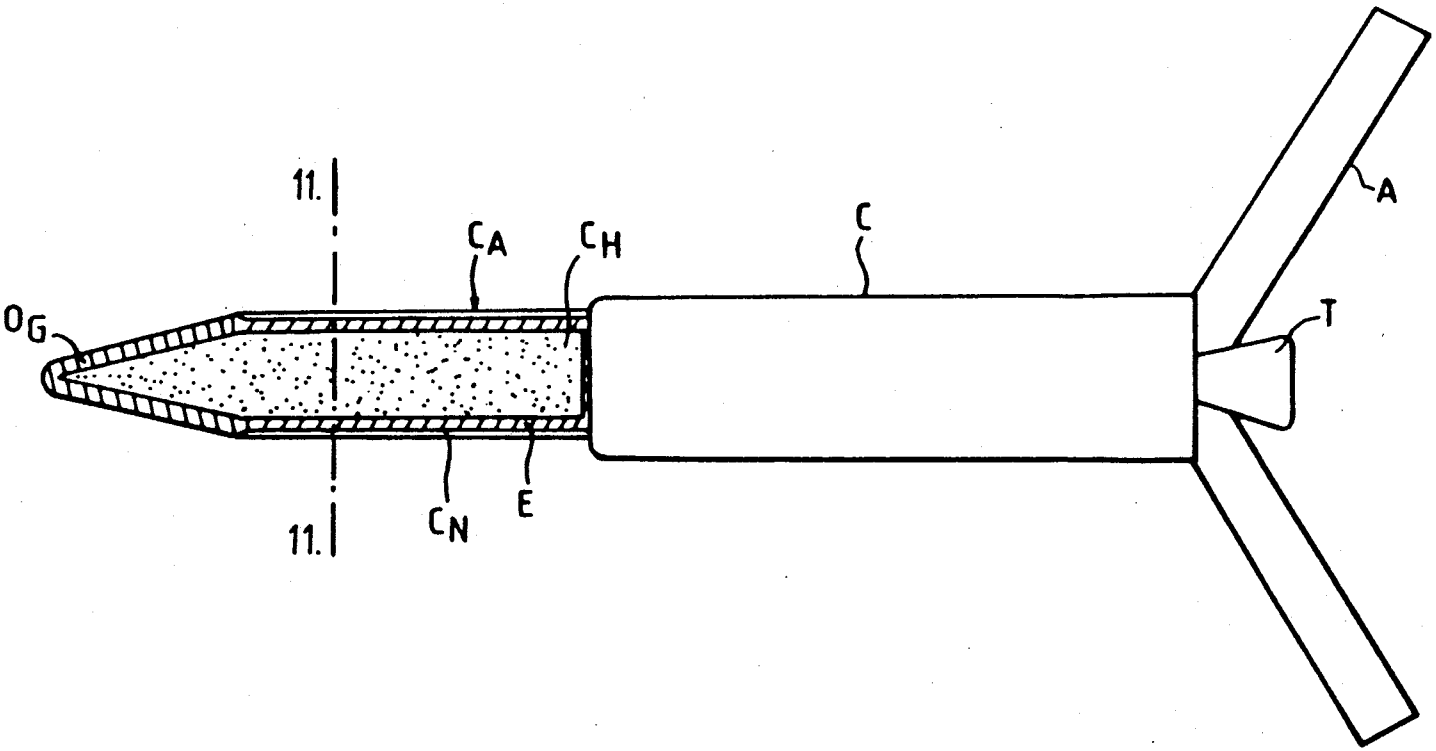
FIG. 10 represents the drawing of an embodiment of the munition according to the invention.

FIG. 10 gives a schematic view of another embodiment of the munition according to the invention.

This munition essentially comprises two parts: a front body $C_A$ designed to perforate the material, for example concrete, forming the target, in penetrating it preferably throughout its length, and a rear body C which may or may not have a diameter greater than that of the front body as shown in the FIG. The rear body C comprises the different mechanical, electronic or pyrotechnical elements needed for the propulsion, guidance, steering or braking of the munition. To this effect it carries, for example, as shown in the FIG., fins A forming a tail unit and a propelling nozzle T.

In this embodiment, the front body $C_A$ is substantially cylindrical and ends, in the front, with a substantially conical nose $O_G$.

Figure 11:
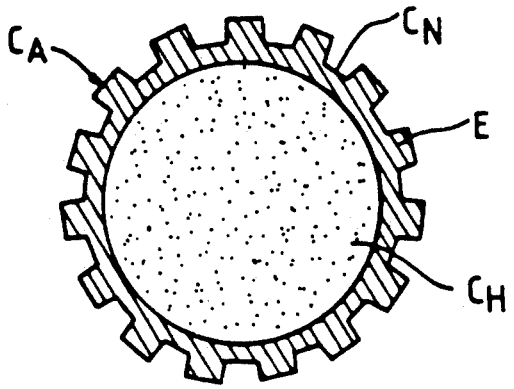
FIG. 11 represents a cross-sectional view of the munition shown in FIG. 10.

FIG. 11 shows a cross-sectional view, made along an axis AA in the cylindrical part of the front body $C_A$.

The body $C_A$ is constituted by a casing E of material having high mechanical strength (steel for example), enclosing an explosive charge $C_H$. The external surface of the casing E, in its cylindrical part, has longitudinal grooves $C_N$, preferably throughout its length. The grooves $C_N$ are shown in FIG. 11 as having a rectangular section but they can be given other shapes, for example square, semi-circular, triangular etc.

The following is the working of the munition according to the invention.

The kinetic energy given to the munition is such that it enables it to perforate the target mass of concrete, which is typically a runway of an aerodrome, in sinking in, preferably throughout the length of the front body $C_A$. This perforation may, in practice, be a complete perforation of the thickness of concrete or only a semi-perforation. When it is completed, a priming fuse (not shown), contained for example in the rear body C, triggers the explosion of the charge $C_H$. The grooves $C_B$ made in the front body $C_A$ have the effect, notably, of diminishing the frictional forces during the penetration of the body $C_A$ into the concrete and, secondly, of increasing the transversal rigidity of the munition during the impact on the concrete in order to reduce the risks of bending of the front body at the instant of entry of the nose.

Furthermore, in one alternative embodiment, the parameters (dimensions, material) of the casing and of the grooves are chosen so that each of the grooves works like a longitudinal hollow charge during the explosion of the charge $C_H$, thus achieving a pre-fracturing of the solid concrete surrounding the body $C_A$. This makes it possible to improve the excavating power of the quantity of explosive charge contained in the munition and, consequently, to enlarge the crater thus formed.

Figure 12:
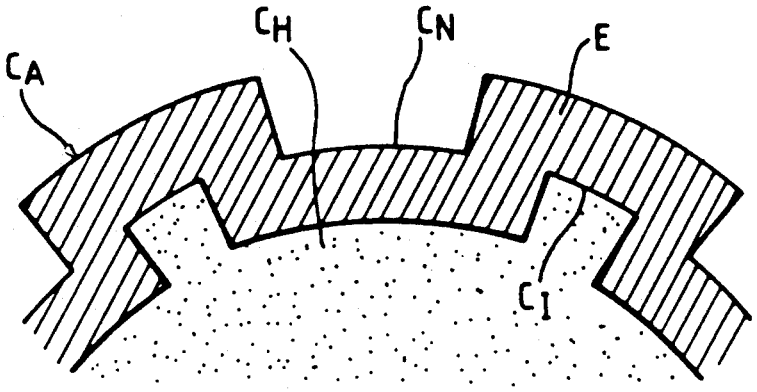
FIG. 12 shows a partial sectional view of an alternative embodiment of the munition according to the invention.

FIG. 12 shows a partial cross-section view of an alternative embodiment of the grooved casing (E) of the front body ($C_A$) of the munition according to the invention.

This FIG. again shows the casing E containing the explosive charge $C_H$, the external surface of which has grooves $C_N$.

According to this variant, the internal surface of the casing E also has longitudinal grooves, referenced $C_I$, alternating with the grooves $C_N$. The dimensions of these grooves $C_I$ are chosen so as to further the above-mentioned hollow charge effect.

According to another alternative embodiment (not shown), the grooves extend over the entire nose $O_G$ or on a part of it.

Figure 13:
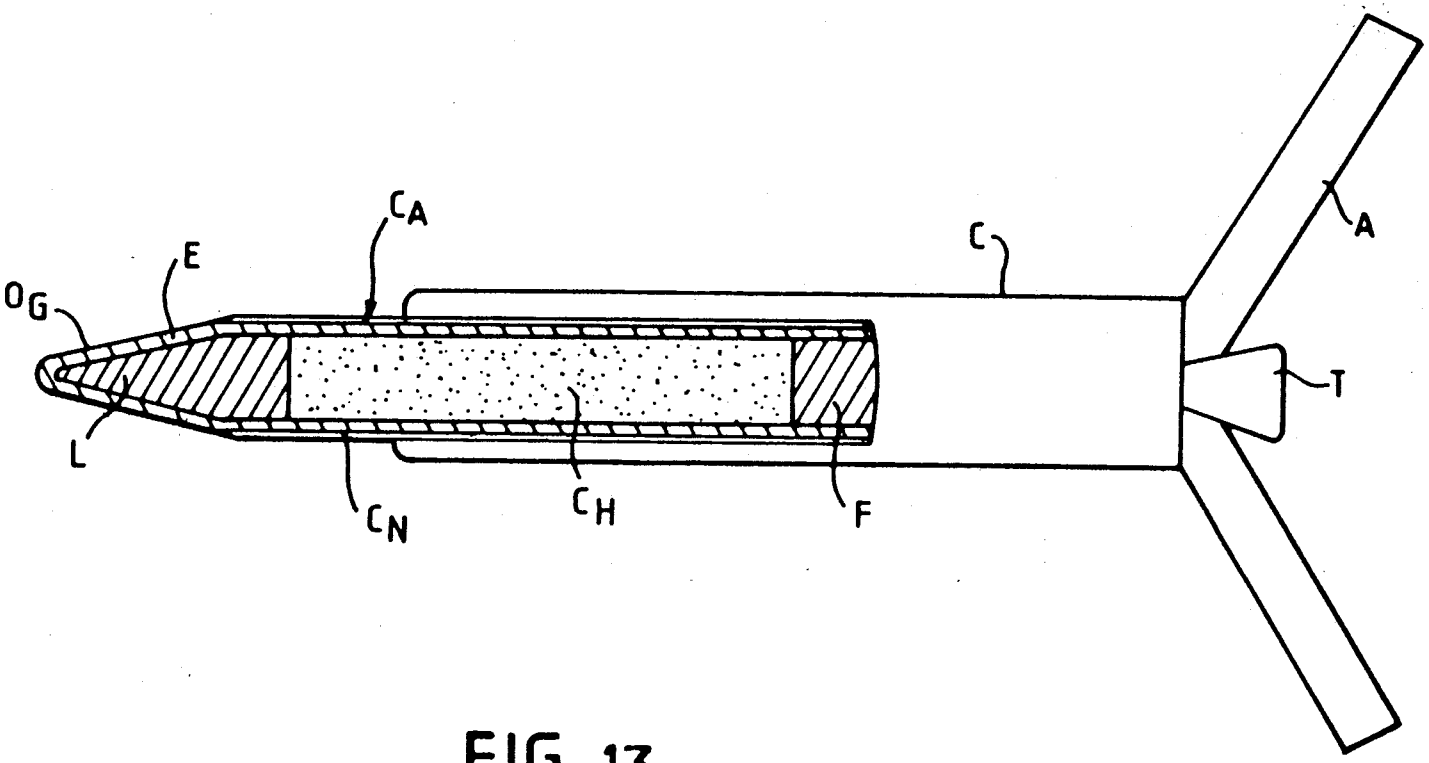
FIG. 13 represents the drawing of alternative embodiments of the munition according to the invention.

FIG. 13 shows a drawing similar to that of FIG. 10, illustrating different alternative embodiments according to the invention.

This FIG. again shows the munition formed by the front body ($C_A$) ending with the nose $O_G$ and by the rear body C bearing fins A and a nozzle T, The front body $C_A$ is formed by the casing E having grooves $C_N$ and containing an explosive charge $C_H$.

According to a first alternative embodiment, the grooved front body $C_A$ which, it may be recalled, is designed to perforate the targeted concrete throughout its length, is extended into the rear body C, which thus covers it in a ring-like way. The fastening of the rear body C to the front body $C_A$ is then such that the body C does not significantly counter the penetration of the front body ($C_A$) into the targeted concrete. This variant has the advantage of increasing the length of the front body $C_A$, for a given total length of munition, thus notably increasing the quantity of explosive charge $C_H$ or, conversely, or reducing the total length of the munitoin for a given length of the body $C_A$. Indeed, the annular space between the bodies $C_A$ and C may be used to position at least some of the elements contained in the body C.

According to another alternative embodiment, the priming fuse of the charge $C_H$, reference F, is placed in the front part $C_A$, behind the charge $C_H$.

According to another alternative embodiment, the front part of the body $C_A$, namely the nose $O_G$ and, possibly, a part of the cylindrical portion of the body $C_A$, is filed no longer with explosive charge but with a dense material L constituting a ballast. This material is formed, for example, by tungsten. This presence of this ballast has the function, firstly, of improving the capacity of penetration of the body $C_A$ by the increasing of it mass, for a given section, and secondly of shifting the center of gravity of the munition frontwards, thus making it possible to reduce the risks of the tilting, bending or ricocheting of the munition at the instant of entry of the nose.

We claim;

1. A munitoin launched from an air vehicle with a horizontal velocity and attitude for attaching a target with a horizontal layout, said munition comprising:

a front part having an explosive charge enclosed therein;

a rear part attached to said front part, said rear part comprising propulsion means for increasing a velocity of the munition to penetrate the target;

breaking means for providing the munition with a first curvature which is substantially vertical, said braking means being positioned at a rear portion of the rear part; and back propulsion means for diminishing the first curvature of the munition caused by the braking means, said back propulsion means comprising means for providing a thrust which is parallel to a longitudinal axis of the munition.

2. The munition according to claim 1, wherein the braking means is connected to a nozzle of the propulsion means by means of a fastening means that can be unlocked.

3. The munition according to claim 1, wherein said braking means comprises a parachute, such that when said braking means are actuated, said parachute is unfolded for providing the munition with said first curvature.

4. The munition according to claim 3, wherein the braking means further comprises a box to for containing the parachute wherein said parachute is in a folded state.

5. The munition according to claim 1, wherein the back propulsion means is fixedly joined to the munition.

6. The munition according to claim 5, wherein the back propulsion means comprises nozzles positioned symmetrically with respect to the longitudinal axis of the munition for providing said thrust parallel to said axis.

7. The munition according to claim 5, wherein the back propulsion means is positioned in a ring-like way around the front part of the munition.

8. The munition according to claim 7, wherein the front part of the munition is covered at least partially in a ring-like way by the rear part of the munition.

* * * * *

UNITED STATES PATENT AND TRADEMARK OFFICE

CERTIFICATE OF CORRECTION

PATENT NO. : 5,189,248

DATED : February 23, 1993

INVENTOR(S) : Jean Deffayet et al.

It is certified that error appears in the above-identified patent and that said Letters Patent is hereby corrected as shown below:

On the title page, Item [22], [86], [87],

The PCT information has been omitted, should read as follows:

--[22] PCT Filed: Jan. 15, 1991--

--[86] PCT No.: PCT/FR91/00023

§ 371 Date: Sept. 16, 1991

§ 102 (e) Date: Sept. 16, 1991--

--[87] PCT Pub. No.:

PCT Pub. Date: --

Signed and Sealed this

Ninth Day of November, 1993

*Attest:*

*Attesting Officer*

BRUCE LEHMAN

*Commissioner of Patents and Trademarks*